US011795732B2

(12) United States Patent
Adams

(10) Patent No.: US 11,795,732 B2
(45) Date of Patent: Oct. 24, 2023

(54) SELF-LOCKING GATE ASSEMBLY

(71) Applicant: Clayton E. Adams, Mason City, IA (US)

(72) Inventor: Clayton E. Adams, Mason City, IA (US)

( * ) Notice: Subject to any disclaimer, the term of this patent is extended or adjusted under 35 U.S.C. 154(b) by 332 days.

(21) Appl. No.: 16/802,097

(22) Filed: Feb. 26, 2020

(65) Prior Publication Data

US 2020/0270906 A1 Aug. 27, 2020

Related U.S. Application Data

(60) Provisional application No. 62/810,679, filed on Feb. 26, 2019.

(51) Int. Cl.

| | |
|---|---|
| ***E06B 9/04*** | (2006.01) |
| ***E05B 63/20*** | (2006.01) |
| ***E05B 65/00*** | (2006.01) |
| *E06B 9/00* | (2006.01) |

(52) U.S. Cl.

CPC ..... *E05B 65/0007* (2013.01); *E05B 63/20* (2013.01); *E05B 65/0014* (2013.01); *E06B 9/04* (2013.01); *E06B 2009/002* (2013.01)

(58) Field of Classification Search

CPC .. E06B 2009/002; E06B 11/022; E06B 11/04; E06B 11/00; E06B 9/04; E05Y 2900/40; E05F 1/1207; E05F 1/12; E05B 65/0007; E05B 65/0014; E05B 63/20

See application file for complete search history.

(56) References Cited

U.S. PATENT DOCUMENTS 1,116,867 A * 11/1914 Anderson ..... E06B 11/04 49/160
1,236,536 A * 8/1917 Boyd ..... E05F 1/1215 16/285
1,996,196 A * 4/1935 Ferris ..... A01K 1/0011 49/237
2,648,092 A * 8/1953 Esslinger ..... E05D 15/50 16/230
2,832,627 A * 4/1958 Batchler ..... E05B 65/0007 16/86 A
3,510,986 A * 5/1970 Berkowitz ..... E05D 7/081 16/256
4,122,631 A * 10/1978 Batcheller ..... E05F 1/1215 49/386
4,330,958 A * 5/1982 Richmond ..... E05B 47/026 49/340
4,472,908 A * 9/1984 Wanzl ..... E05F 15/614 49/141
5,050,344 A * 9/1991 Skeem ..... E05F 1/066 49/245
5,557,889 A * 9/1996 Sharp ..... E04H 17/1447 49/386
5,921,027 A * 7/1999 Siebenahler ..... E06B 11/04 49/160

(Continued)

*Primary Examiner* — Justin B Rephann
(74) *Attorney, Agent, or Firm* — ZarleyConley PLC

(57) ABSTRACT

A self-locking gate assembly having a gate with a first hollow member and a second hollow member connected by a vertical support. A locking assembly, associated with the first hollow member is operatively connected to an upper mounting assembly adapted to open and automatically close the gate based upon activation and deactivation of the locking assembly.

19 Claims, 10 Drawing Sheets

(56) References Cited

U.S. PATENT DOCUMENTS 6,094,863 A * 8/2000 LaCook, Jr. ..... E06B 11/02 49/49
7,152,372 B2 * 12/2006 Cheng ..... E06B 9/04 49/55
8,607,502 B2 * 12/2013 Flannery ..... E05B 17/2038 49/55
8,733,017 B2 * 5/2014 Marsden ..... E05D 11/1064 49/386
9,032,666 B2 * 5/2015 Honeycutt ..... E05F 1/1207 49/55
9,279,284 B1 * 3/2016 Axelrod ..... E06B 7/32
9,476,239 B2 * 10/2016 Honeycutt ..... E06B 3/921
9,719,299 B2 * 8/2017 Honeycutt ..... E06B 3/921
9,822,585 B2 * 11/2017 Flannery ..... E06B 9/02
9,926,738 B1 * 3/2018 Brown ..... E06B 9/04
10,253,538 B2 * 4/2019 Honeycutt ..... E06B 3/921
10,626,650 B2 * 4/2020 Honeycutt ..... E05F 1/12
10,697,236 B2 * 6/2020 King ..... E05D 7/02
10,975,621 B2 * 4/2021 Gentil ..... E05B 65/0007
2003/0009945 A1 * 1/2003 Cheng ..... E06B 9/04 49/55
2003/0230328 A1 * 12/2003 Chen ..... E06B 11/08 135/67
2007/0113378 A1 * 5/2007 Talpe ..... E05F 1/1215 16/298
2008/0061561 A1 * 3/2008 Uryasov ..... E05B 47/026 292/40
2009/0205255 A1 * 8/2009 Shelton ..... E06B 9/04 49/56
2012/0055092 A1 * 3/2012 Boucquey ..... E05B 65/0014 49/386
2012/0324792 A1 * 12/2012 Bertsch ..... E06B 9/04 49/37
2013/0097806 A1 * 4/2013 Pate, Jr. ..... E05F 1/1215 16/76
2013/0212950 A1 * 8/2013 Bertsch ..... E06B 9/04 49/464
2013/0219790 A1 * 8/2013 Honeycutt ..... E06B 3/921 49/176
2014/0318018 A1 * 10/2014 Huang ..... E06B 11/025 49/386
2015/0252605 A1 * 9/2015 Honeycutt ..... E06B 11/022 49/386
2016/0369560 A1 * 12/2016 Honeycutt ..... E05D 7/0009
2017/0058594 A1 * 3/2017 Marsden ..... E06B 9/04
2018/0044984 A1 * 2/2018 Honeycutt ..... E06B 11/00
2018/0112457 A1 * 4/2018 Raffi ..... E05C 19/06
2019/0136619 A1 * 5/2019 Flannery ..... E05B 65/0007
2019/0226258 A1 * 7/2019 Honeycutt ..... E06B 11/04
2019/0338588 A1 * 11/2019 King ..... E05D 7/1044
2020/0087964 A1 * 3/2020 Gentil ..... E05B 65/0014

* cited by examiner

SELF-LOCKING GATE ASSEMBLY

CROSS REFERENCE TO RELATED APPLICATION

This application claims the benefit of U.S. Provisional Application No. 62/810,679 filed Feb. 26, 2019, the contents of this application is hereby incorporated by reference in its entirety.

BACKGROUND OF THE INVENTION

The present invention is directed to a gate and more particularly to a gate that is self-closing.

Gates are well-known in the art and are used to provide selective access to an enclosed area. One such use is to mount a gate at the top of a staircase to prevent young children from falling down the stairs. Most gates for this type of use are mounted on one side and require a catch for a latch and lock on the opposite side. While useful, because mounts are required on both sides, these gates are more difficult and time consuming to install. Also, often one forgets to close the gate which defeats the gate's purpose. Therefore, a need exists in the art for a gate that addresses these deficiencies.

An objective of the present invention is to provide a gate that is self-locking.

Another objective of the present invention is to provide a gate that is easier to install.

These and other objectives will be apparent to one having ordinary skill in the art based upon the following written description, drawings, and claims

SUMMARY OF THE INVENTION

A self-locking gate assembly includes a gate having a hollow top member connected to a hollow bottom member. Associated with the top hollow member is a locking assembly.

Both the top hollow member and the locking assembly are connected to an upper mounting assembly having a mounting plate, a mounting shaft and a mounting guide tube. The mounting plate is connected to a support such as a wall or stud. The mounting guide tube is connected to the top hollow member and fits over the mounting shaft to permit the guide tube and gate to rotate about the shaft and/or be raised and lowered in relation to the shaft.

The locking assembly extends from the top hollow member, through the mounting guide tube, and into the mounting shaft to hold the gate in a closed or locked position. The locking assembly has a spring pin that when activated retracts the locking assembly from the mounting shaft permitting the gate to open. When the spring pin is released the locking assembly is biased back toward and into the mounting shaft by a spring. Slots on a bottom edge of the mounting guide tube that engage and receive projections on the mounting shaft, through gravity, move the gate back toward a closed position.

DETAILED DESCRIPTION

Figure 1:
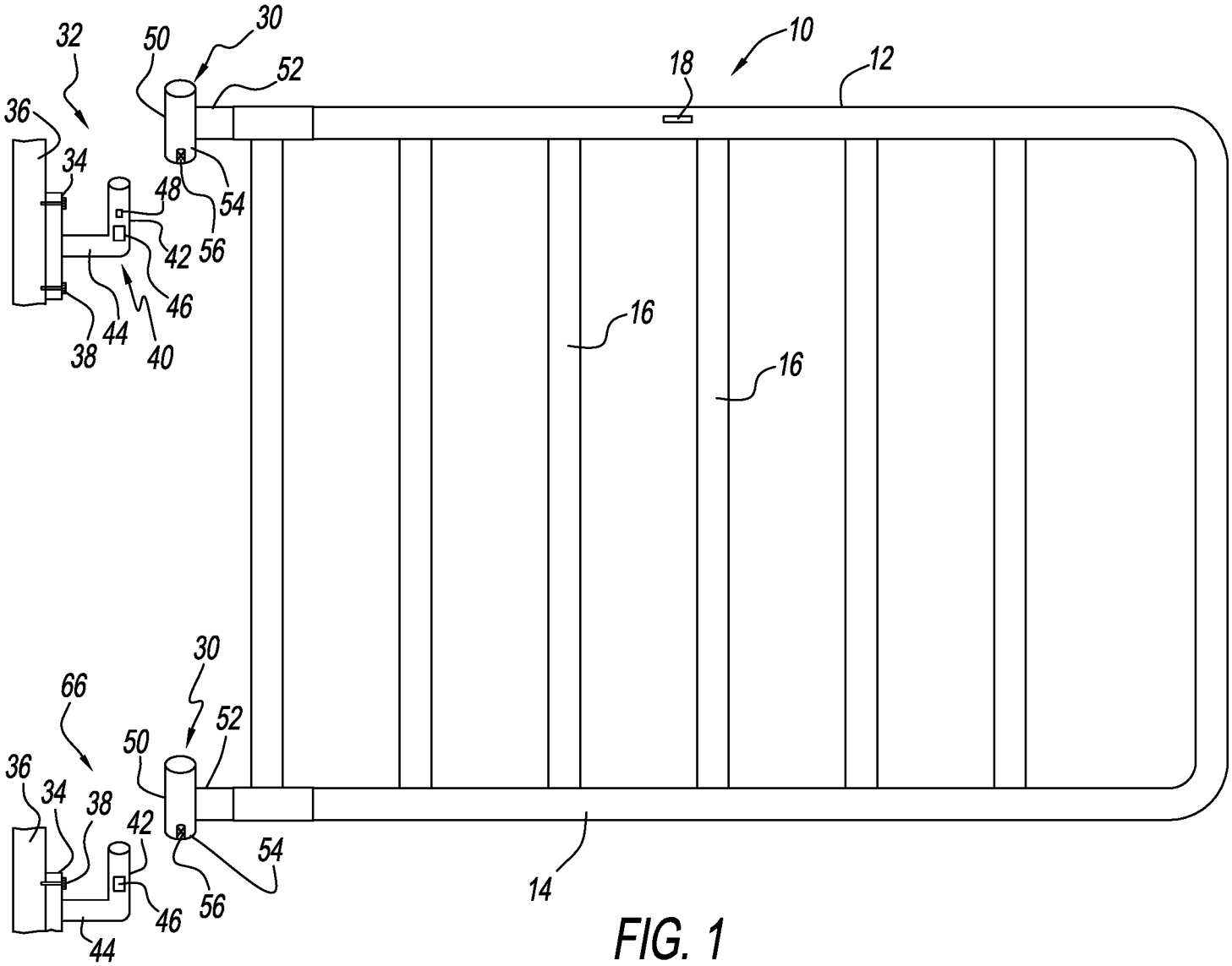
FIG. 1 is a front view of a self-locking gate assembly.
Figure 2:
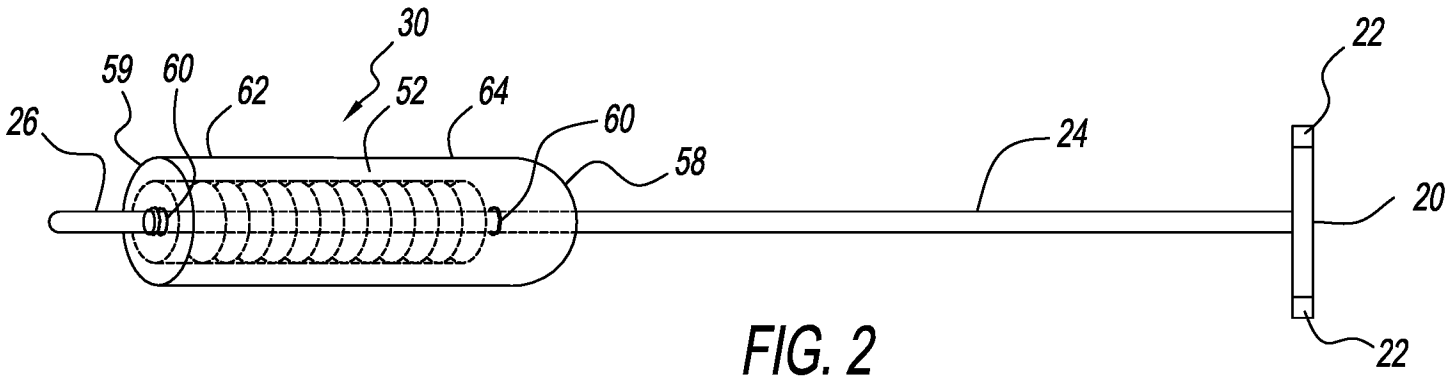
FIG. 2 is a side view of a locking assembly.
Figure 3:
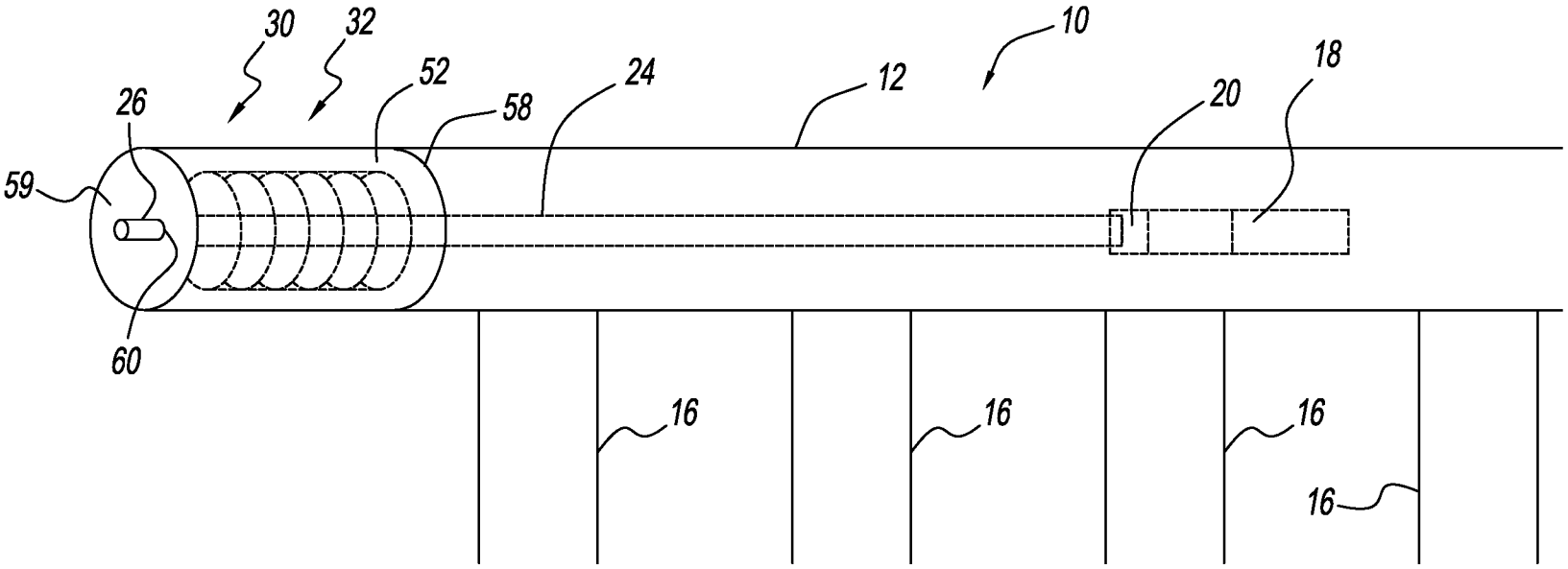
FIG. 3 is a side section view of a self-locking gate assembly.
Figure 4:
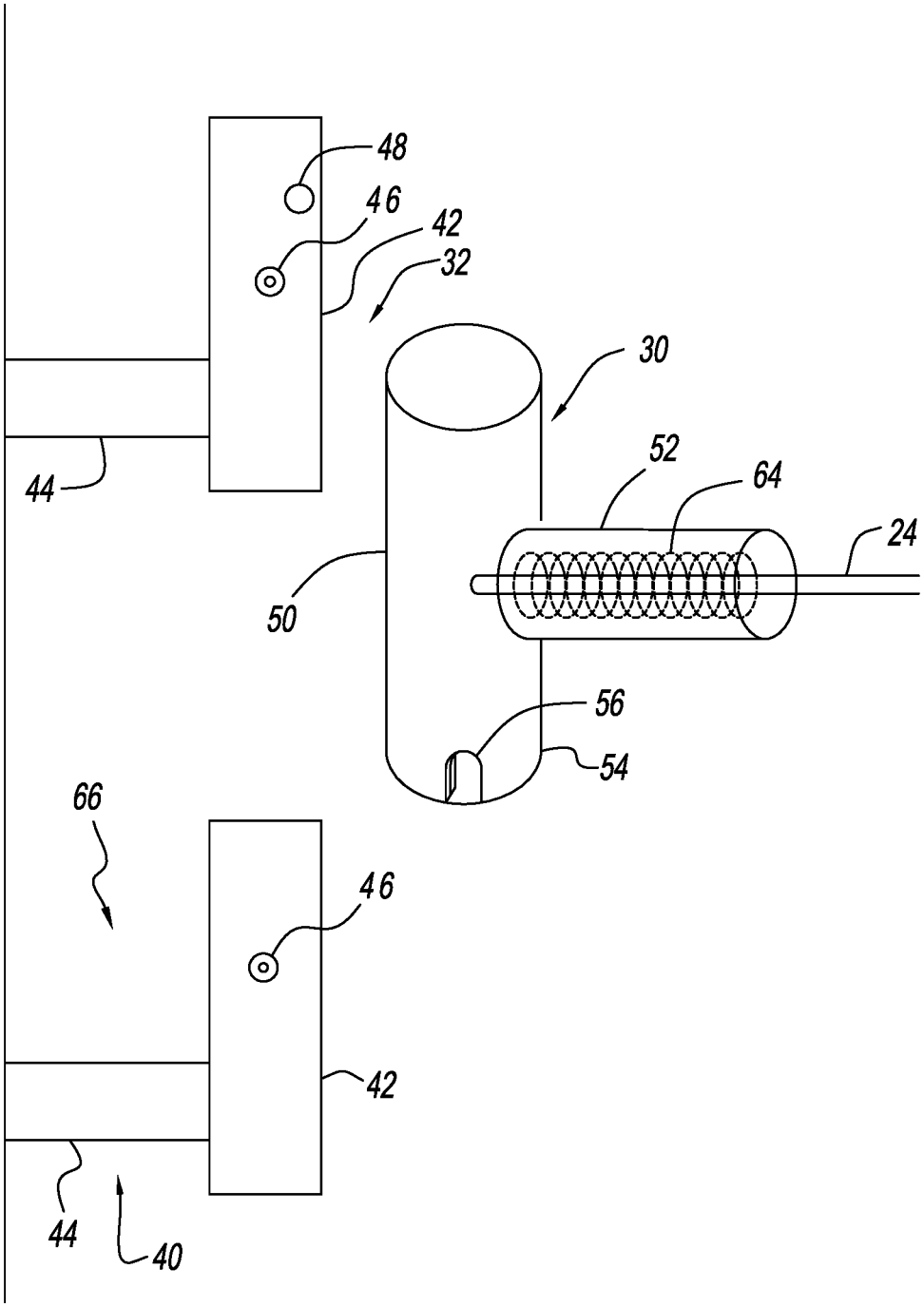
FIG. 4 is a side view of a mounting assembly.
Figure 5:
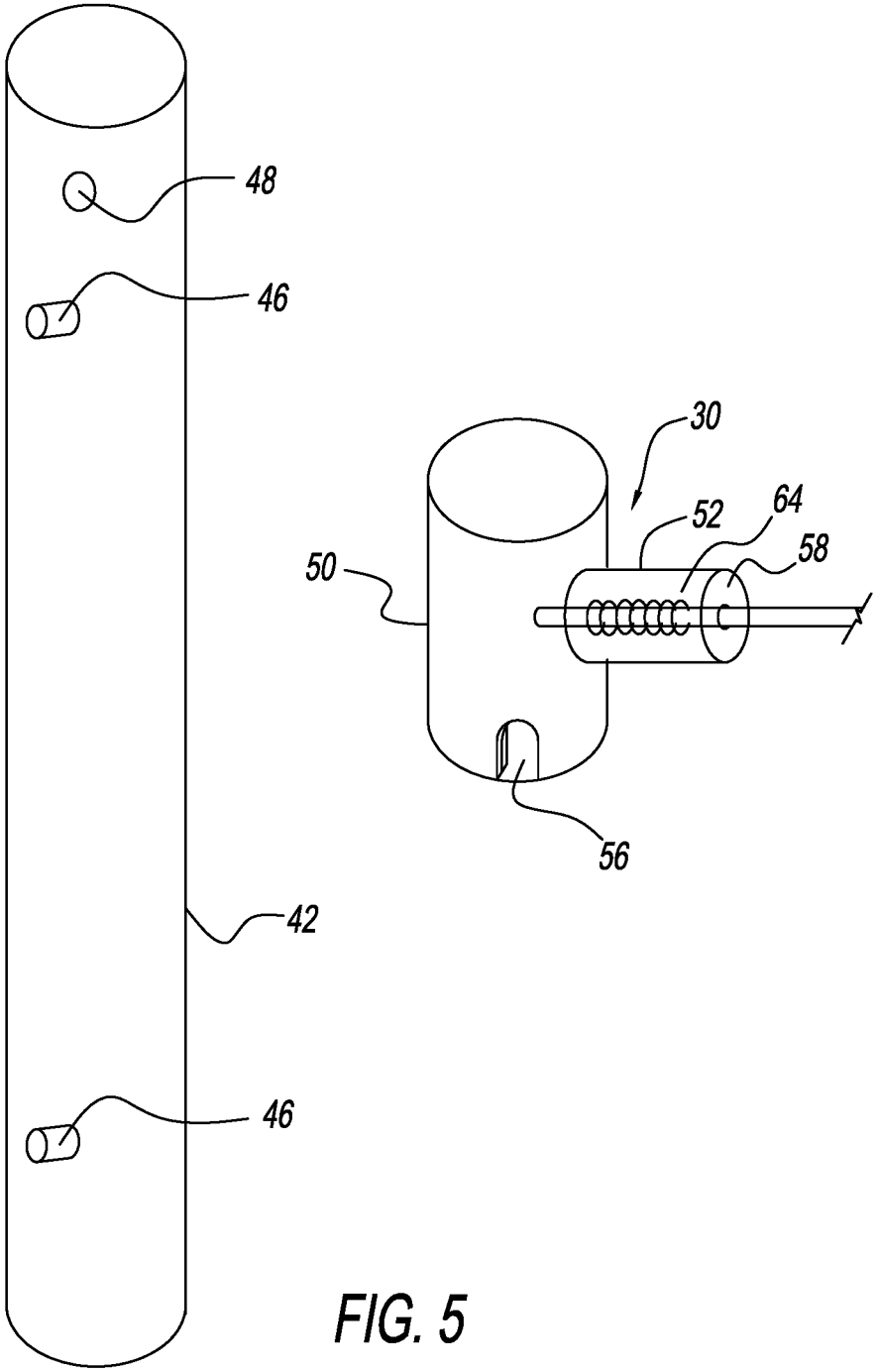
FIG. 5 is a side view of a mounting assembly.
Figure 6:
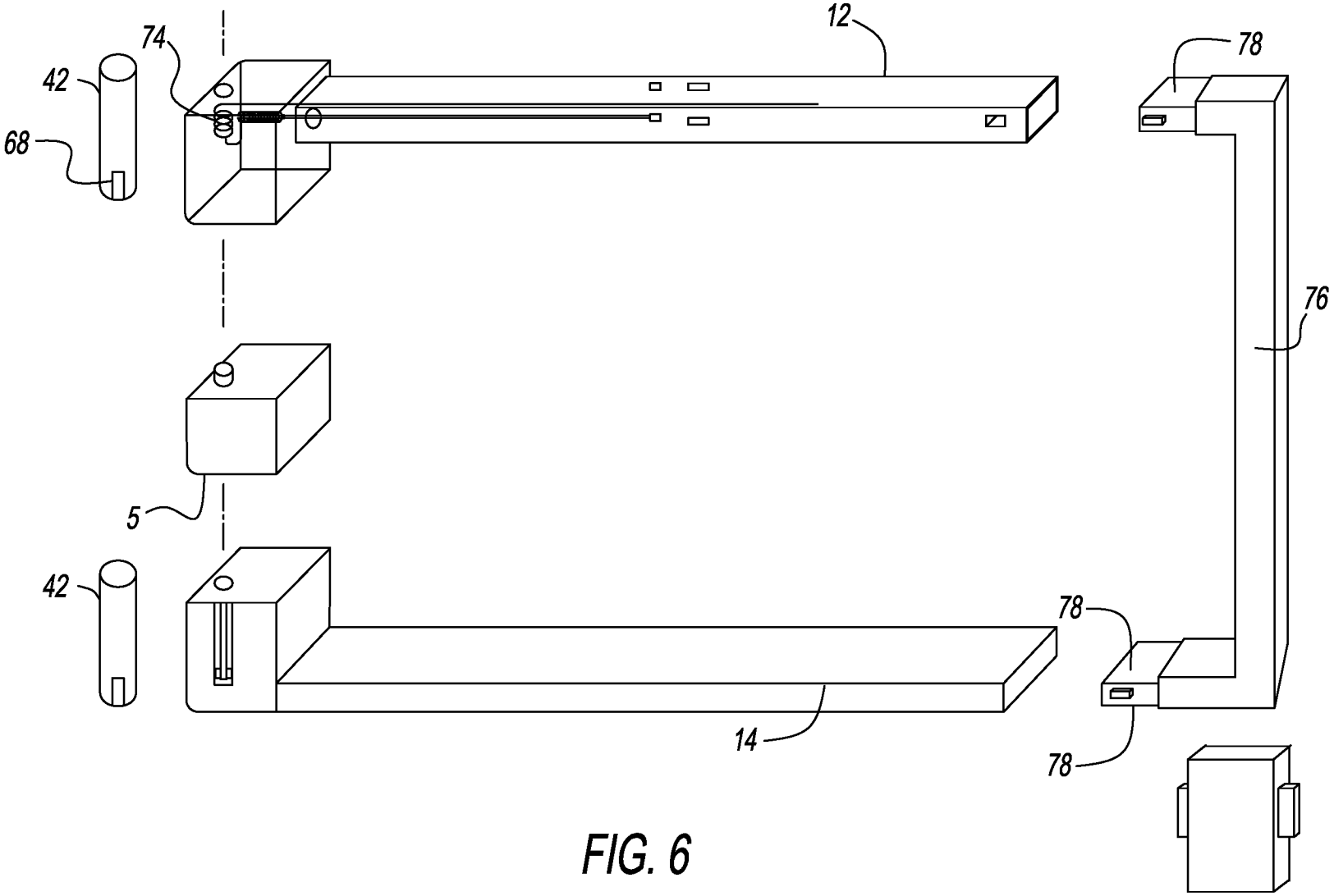
FIG. 6 is a perspective view of a self-locking gate assembly.
Figure 7:
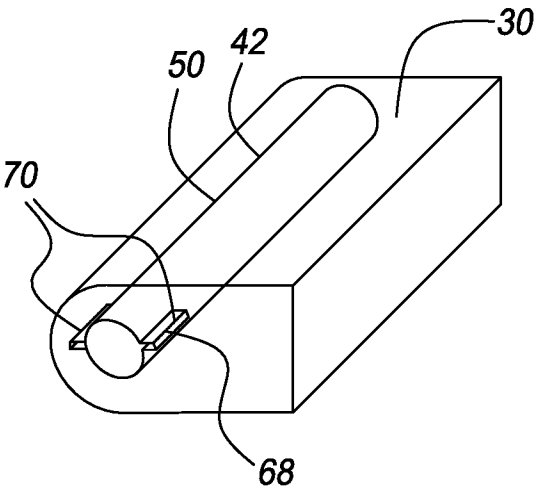
FIG. 7 is a perspective view of a portion of amounting assembly.
Figure 7:
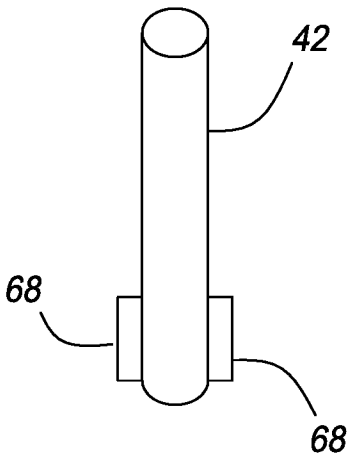
Figure 8:
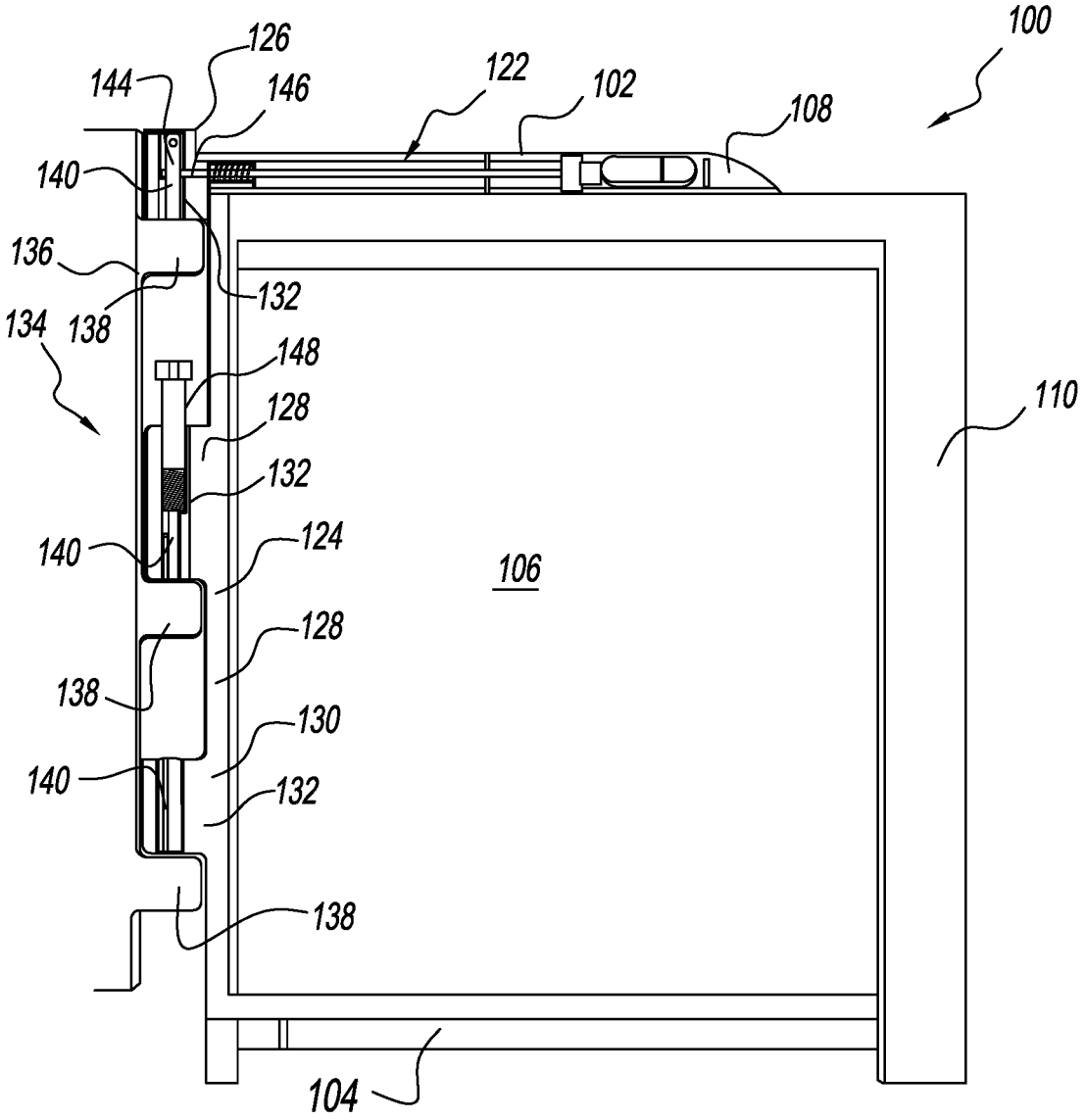
FIG. 8 is a side sectional of a gate assembly.
Figure 9:
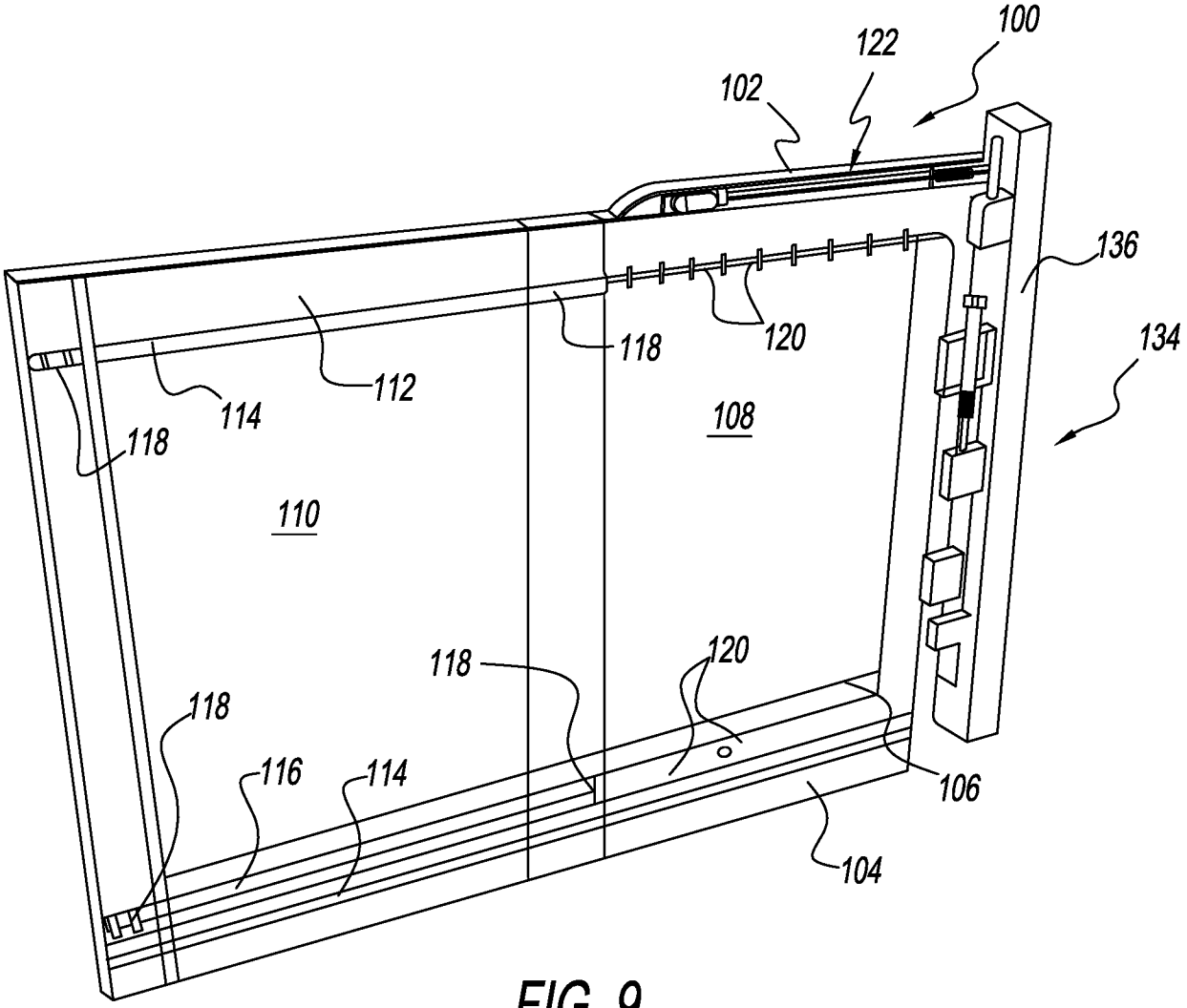
FIG. 9 is a perspective sectional view of a gate assembly.
Figure 10:
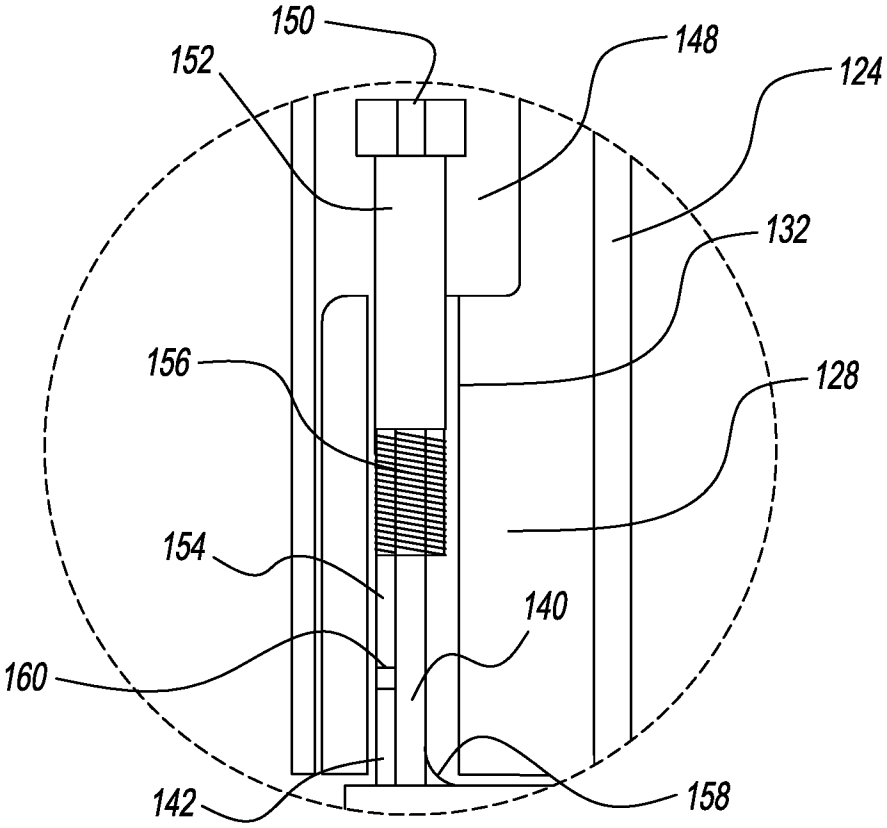
FIG. 10 is a partial side sectional view of a mounting assembly.
Figure 11:
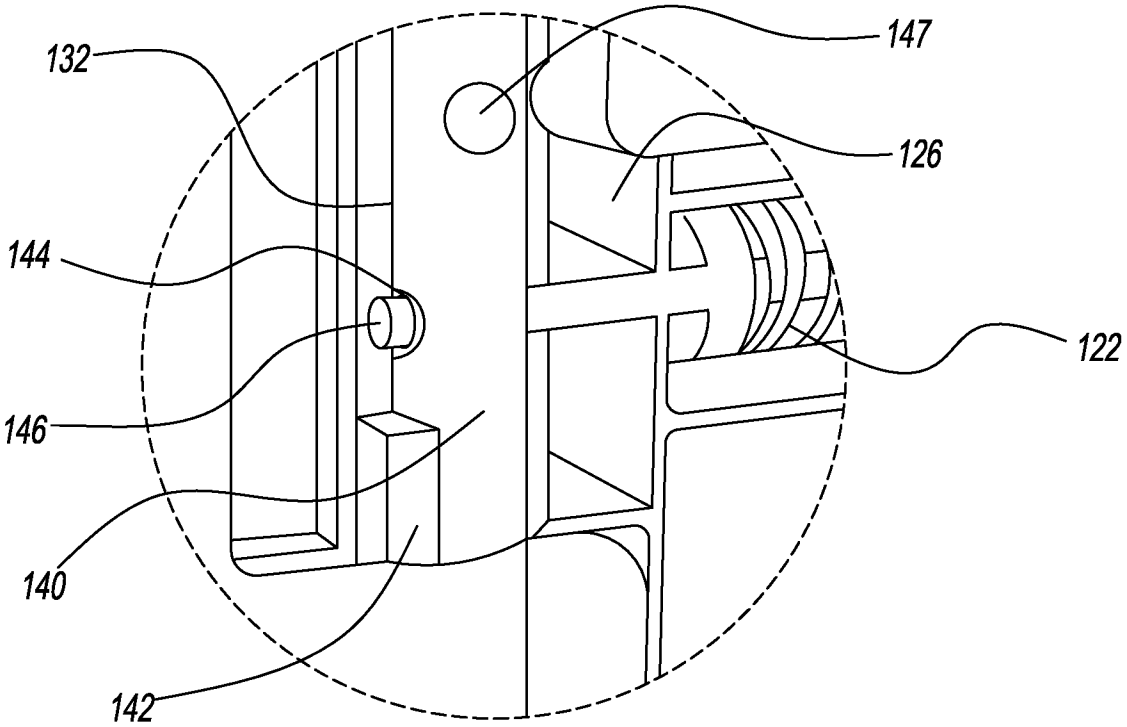
FIG. 11 is a partial perspective view of a mounting assembly.

Referring to the Figures, a self-locking gate assembly 10 has a first or top hollow tube or member 12 connected to a second or bottom tube member 14 by a vertical support such as a plurality of vertical support tubes 16 or alternatively a vertical panel or screen. The top tube 12 has an elongated slot 18 that is preferably positioned in the center of the top tube 12.

Extending through the slot 18 and the top tube 12 is a locking assembly 19. The locking assembly 19 has a spring pin 20 that extends through the slot 18. The spring pin 20 is of any size, shape, and structure and in a preferred embodiment has push buttons 22 at each end of the spring pin 20 that compress under manual pressure to release the spring pin 20 from the top tube 12.

Extending transversely away from and connected to the spring pin 20 is a linkage rod 24 which has a locking pin or tip 26 at an opposite end 28. Alternatively, a cable or roller is used instead of a linkage rod 24. The opposite end 28 of the linkage rod 24 extends beyond and out of the top tube 12 and is received within a guide tube 30 of an upper mounting assembly 32.

The upper mounting assembly 32 has a mounting plate 34 that is attached to a fixed support 36 such as a wall, or stud, or the like with a wood screw 38 or similar attachment device. Extending outwardly from the mounting plate 34 is a mounting shaft 40 that has a vertical section 42 and a horizontal section 44. Adjacent the horizontal section 44 and extending outwardly from the vertical section 42 is a locking stud 46. Above the locking stud 46 on the vertical section 42 of the mounting shaft 40 is a locking pin hole 48. The locking pin hole 48 is positioned to align with and selectively receive the locking pin 26 of the linkage rod 24.

The guide tube 30 of the upper mounting assembly 32 has a vertical section 50 and a horizontal section 52. The vertical section 50 fits over the vertical section 42 of the mounting shaft 40 and can be moved up and down in a vertical direction or rotate about the vertical section 42 of the mounting shaft 40. On a lower edge 54 of the vertical section 50 is a cut-out 56 on opposite sides that is configured to receive the locking stud 46. Preferably, as the lower edge 54 extends away from the cut-out 56 it is metered or angled upwardly.

The horizontal section 52 extends transversely away from and is in communication with the vertical section 50. The ends of the horizontal section 52 have walls 58 and 59 that have aligned and centrally located apertures 60. The linkage rod 24 extends through the apertures 60 and the vertical section 50 where the locking pin hole 48 within the horizontal section 52 adjacent the vertical section 50 is a backing plate 62 that is connected to the linkage rod 24. A spring 64 is disposed between the backing plate 62 and wall 58 to bias the linkage rod 24 away from top tube 12 to a normal or locked position. The horizontal section 52 also receives and is connected to an end of the top tube 12.

The bottom tube 14 is attached to a bottom mounting assembly 66. The bottom mounting assembly 66 is the same as upper mounting assembly 32 except that the vertical section does not have a locking pin hole or a spring and backing plate disposed within the horizontal section 52.

In operation, in its normal position, the gate is locked. In a locked position the locking pin 26 of the linkage rod 24 is biased outwardly by spring 64 and is received within locking pin hole 48. Also, locking studs 46 are received within cut-outs 56.

To open the gate, spring pin 20 is compressed manually which permits one to manually move the linkage rod 24 away from upper mounting assembly 32. By moving compressed spring pin 20 along slot 18, the backing plate 62 compresses spring 64 and locking pin 26 is withdrawn from locking pin hole 48.

Once locking pin 26 is removed from locking pin hole 48 the gate 10 is lifted vertically. By lifting the gate 10 vertically the guide tubes 30 are also lifted and the locking studs 46 are withdrawn from the cut-outs 56. Once the locking studs 46 are withdrawn, the gate is opened which causes vertical section 50 of guide tube 30 to rotate about the vertical section 42 of mounting shaft 40.

When the gate 10 is released, the lower edge 54 of the vertical section 50 of guide tube 30 engages locking stud 46. Because of the angled or metered shape the lower edge 54 slides along the locking stud 46 while vertical section 50 rotates about vertical section 42 until locking stud 46 aligns with cut-out 56 and guide tube 30 falls into a locked position. At this time, based upon the bias of spring 64, locking pin 26 will extend into locking pin hole 48 once they are aligned.

In an alternative embodiment the vertical section 42 of the mounting shaft 40 has a pair of outwardly extending projections or keys 68. The keys 68 are positioned to align with slots 70 in the vertical section 50 of guide tube 30. Disposed within vertical section 50, which is closed at a top end with cap 72, is a spring 74. The spring biases the gate downward in a normal or closed position. In the closed position the keys 68 are received in slots 70.

To open the gate, the gate is manually lifted causing the spring 74 to compress and the guide tube 30 slots 70 to lift off of the keys 68 which permits the gate to rotate about vertical section 42. To close the gate, the gate is rotated to a closed position wherein the slots 70 align with keys 68 and spring forces the gate downward so that the keys 68 are received within slots 70.

In a similar embodiment the vertical section 42 has spring prongs 75 that extend outwardly and are selectively received in slots 70 or holes in the vertical section 50.

Also, an extension 76 can be added to the end of the gate opposite the mounting assembly 32. In one example the extension 76 is c-shaped having a pair of turned down ends 78. The turned down ends 78 are positioned to align with tubes 12 and 14 and sized to be slidably and frictionally received within tubes 12 and 14.

In another embodiment, a self-locking gate assembly 100 has a top member 102 connected to a bottom member 104 by a vertical support 106. The members 102, 104 and support 106 are hollow and form a chamber 108. Slidably disposed within the chamber 108 is an extension panel 110. The extension panel 110 has a top rail 112 and a bottom rail 114 that are slidably received within the top member 102 and the bottom member 104. Below the top rail 112 and above the bottom rail 114 are grooves 116. Associated with each end of the grooves are internal locking mechanisms 118. Also, along an inner surface of members 102, 104 and support 106 are a plurality of horizontally aligned stoppers 120.

Disposed within the top member 102 is a locking assembly 122 having the same parts, structure, and function as previously described. Attached to an end 124 opposite the extension panel are an upper 126, a middle 128, and a bottom 130 mounting guide. All three guides 126, 128, and 130 have a bore 132 that extends vertically through each guide 126, 128, and 130.

The mounting guides 126, 128, and 130 are operatively connected to a mounting support 134 that is attached to a wall, a stud, or the like. The mounting support 134 has an elongated member 136 with a plurality of mounting arms 138 that extend perpendicularly away from member 136 toward end 124 of the gate assembly 100. Each mounting arm 136 has a mounting shaft 140 that extends parallel to member 136 and perpendicular from the mounting arms 138. Each mounting shaft 140 has a locking key 142 and is positioned and adapted to be received within the bore 132 of the mounting guides 126, 128, and 130.

The mounting shaft 140 adjacent the upper mounting guide 126 has a locking pin hole 144 positioned to align with and selectively receive the locking pin 146 of the locking assembly 122 and a second locking pin hole 147 positioned to align with and selectively receive the locking pin 146 to hold the gate assembly 100 in an open position. The middle mounting guide 128 has a tension adjustable knob 148 that is threadably received within bore 132. The knob 148 has a head 150 and a shaft 152 extending from the head into the bore 132.

Positioned between an end of the shaft 152 and a shoulder 154 within the bore 132 is a spring 156. Cut within the bore 132 below the shoulder 154 is an angled cam surface 158 that receives a cam or roller 160 that is attached to the mounting shaft 140.

In operation, the gate assembly 100 is opened by engaging the locking assembly and withdrawing the locking pin 146 from the locking pin hole 144. Once withdrawn, the gate assembly 100 is raised using manual force until the mounting guides 126, 128, and 130 clear the locking keys 142 of the mounting shafts 140. Once cleared, the mounting guides 126, 128, and 130 are rotated about the mounting shafts 140 causing the gate assembly 100 to move to an open position. The gate assembly 100 is locked in an open position by releasing the locking assembly 122 which, based on spring force, causes the locking pin 146 to extend into the second locking pin hole 147.

To automatically close the gate assembly 100 the locking assembly 100 is engaged causing the locking pin 146 to retract from second locking pin hole 147 and then the assembly is released. Once released, gravity, as well as spring force from spring 156, which was condensed when the gate assembly was raised, cause the gate assembly 100 to move downwardly. The amount of downward force is adjusted by rotating the tensioning knob. As the gate assembly 100 moves downwardly, the cam 160 travels along the cam surface 158 causing the gate assembly to rotate back toward a closed position. At the closed or locked position the locking pin 146, through spring force is inserted in the locking pin hole 144 and rotational movement is further prevented by the locking keys 142.

From the above discussion and accompanying figures and claims it will be appreciated that the self-locking gate 10 offers many advantages over the prior art. It will be appreciated further by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in light thereof will be suggested to persons skilled in the art and are to be included in the spirit and purview of this application.

What is claimed is:

1. A self-locking gate assembly, comprising:

a gate having a first hollow member and a second hollow member connected by a vertical support;

a locking assembly having a locking pin positioned in the first hollow member;

an upper mounting guide positioned in the first hollow member;

the upper mounting guide operatively connected to the locking pin of the locking assembly to position the locking pin in a locked position to lock the gate in a closed position and an open position, wherein when the locking pin is disengaged from the locked position and the gate in is the open position, the gate rotates about the upper mounting guide until the gate is in the closed position without manual manipulation;

the upper mounting guide having a guide tube having a vertical section and a horizontal section that extends transversely away from the vertical section; and the horizontal section of the guide tube has walls with aligned apertures adapted to receive the locking pin;

wherein connected to the locking pin is a backing plate that is positioned to engage a spring to bias the locking pin to the locked position.

2. The assembly of claim 1 wherein the upper mounting guide has a mounting shaft with an outwardly extending projection that aligns with a bore in the guide tube.

3. The assembly of claim 2 wherein a second spring disposed in the vertical section of the guide tube is configured to bias the gate toward the closed position.

4. A self-locking gate assembly, comprising:

a gate having a first hollow member and a second hollow member connected by a vertical support;

a locking assembly associated with the first hollow member;

a plurality of mounting guides attached to the gate and configured to permit the gate to transition between an open position to a closed position upon disengagement of the locking assembly from the plurality of mounting guides; and wherein a middle mounting guide of the plurality of mounting guides has a bore that receives a spring and a tensioning knob, wherein the bore of the middle mounting guide has an angled cam surface that engages a roller attached to a mounting shaft and the roller is configured to travel along the angled cam surface as the gate transitions between the open position to the closed position.

5. The assembly of claim 4 wherein the locking assembly interacts with at least one of the plurality of mounting guides to lock the gate in the open position and the closed position.

6. A self-locking gate assembly, comprising:

a gate;

the gate having a top member connected to a bottom member by a vertical support;

a locking assembly having a locking pin disposed within the top member;

an upper mounting guide disposed within the top member;

a first locking pin hole positioned through the upper mounting guide to align with and selectively receive the locking pin when the gate is locked in a closed position; and a mounting support having an upper mounting arm extending perpendicularly from an elongated member, and the upper mounting arm having a first mounting shaft that extends perpendicularly from the upper mounting arm and is slidably received in a first bore extending through the upper mounting guide.

7. The assembly of claim 6 further comprising the upper mounting arm having a locking key, wherein first locking key is configured to limit rotational movement of the upper mounting guide.

8. The assembly of claim 6 further comprising the first locking pin hole extending through the upper mounting arm, wherein the locking pin extends through the first locking pin hole in the upper mounting arm when the gate is locked in the closed position.

9. The assembly of claim 8 further comprising a second locking pin hole positioned through the upper mounting guide to align with and selectively receive the locking pin when the gate is locked in an open position.

10. The assembly of claim 9 further comprising the second locking pin hole extending through the upper mounting arm, wherein the locking pin extends through the second locking pin hole in the upper mounting arm when the gate is locked in the open position.

11. The assembly of claim 6 further comprising the mounting support having a middle mounting arm extending perpendicularly from the elongated member, and the middle mounting arm having a second mounting shaft that extends perpendicularly from the middle mounting arm and is slidably received in a second bore extending through a middle mounting guide disposed within the vertical support.

12. The assembly of claim 11 further comprising a tension adjustable knob having a shaft threadably received within the second bore, and a spring positioned between the shaft and a shoulder extending into the second bore of the middle mounting guide.

13. The assembly of claim 12 further comprising an angled surface cut within the second bore below the shoulder, and a roller connected to the second mounting shaft that engages the angled surface, wherein the roller travels along the angled surface when the gate is transitioned between the closed position and an open position.

14. The assembly of claim 6 further comprising a mounting support having a mounting arm extending perpendicularly from an elongated member, the mounting arm having a second mounting shaft that extends perpendicularly from the mounting arm and is slidably received in a bore extending through a mounting guide disposed within the vertical support, and the mounting arm having a locking key, wherein the locking key is configured to limit rotational movement of the gate.

15. The assembly of claim 6 further comprising an extension panel having a top rail slidably received in the top member and a bottom rail slidably received in the bottom member.

16. The assembly of claim 15 wherein below the top rail is a first groove and above the top rail a second groove, and the first groove and the second groove each having an internal locking mechanism.

17. The assembly of claim 16 further comprising the top member, the bottom member, and the vertical support having a plurality of stoppers.

18. A self-locking gate assembly, comprising:

a gate;

the gate having a top member connected to a bottom member by a vertical support;

a locking assembly having a locking pin disposed within the top member;

an upper mounting guide disposed within the top member;

a first locking pin hole positioned through the upper mounting guide to align with and selectively receive the locking pin when the gate is locked in a closed position; and a mounting support having a mounting arm extending perpendicularly from an elongated member, the mounting arm having a mounting shaft that extends perpendicularly from the mounting arm and is slidably received in a bore extending through a mounting guide disposed within the vertical support, and the mounting arm having a locking key, wherein the locking key is configured to limit rotational movement of the gate.

19. A self-locking gate assembly, comprising:

a gate;

the gate having a top member connected to a bottom member by a vertical support;

a locking assembly having a locking pin disposed within the top member;

an upper mounting guide disposed within the top member;

a first locking pin hole positioned through the upper mounting guide to align with and selectively receive the locking pin when the gate is locked in a closed position; and an extension panel having a top rail slidably received in the top member and a bottom rail slidably received in the bottom member;

wherein below the top rail is a first groove and above the top rail a second groove, and the first groove and the second groove each having an internal locking mechanism.

* * * * *